US008147118B2

(12) United States Patent
Schmied et al.

(10) Patent No.: US 8,147,118 B2
(45) Date of Patent: Apr. 3, 2012

(54) APPARATUS FOR HOMOGENIZING POWDER

(75) Inventors: Ralf Schmied, Freiberg (DE); Heinrich Loecht, Rudersberg (DE)

(73) Assignee: Robert Bosch GmbH, Stuttgart (DE)

( * ) Notice: Subject to any disclaimer, the term of this patent is extended or adjusted under 35 U.S.C. 154(b) by 637 days.

(21) Appl. No.: 12/305,708

(22) PCT Filed: Jun. 13, 2007

(86) PCT No.: PCT/EP2007/055800

§ 371 (c)(1),
(2), (4) Date: Dec. 19, 2008

(87) PCT Pub. No.: WO2008/012139

PCT Pub. Date: Jan. 31, 2008

(65) Prior Publication Data

US 2010/0157721 A1 Jun. 24, 2010

(30) Foreign Application Priority Data

Jul. 28, 2006 (DE) ..... 10 2006 035 051

(51) Int. Cl.

| | |
|---|---|
| ***B01F 3/18*** | (2006.01) |
| ***B01F 11/00*** | (2006.01) |
| ***B01F 13/02*** | (2006.01) |
| ***B65B 1/16*** | (2006.01) |
| ***A61J 3/07*** | (2006.01) |

(52) U.S. Cl. ..... 366/104; 366/117; 366/335

(58) Field of Classification Search ..... 366/104, 366/117, 152.6, 196, 335; 241/224; 222/200, 222/234

See application file for complete search history.

(56) References Cited

U.S. PATENT DOCUMENTS

| | | | | |
|---|---|---|---|---|
| 279,982 | A | 6/1883 | Reid | |
| 1,712,235 | A | 5/1929 | Small | |
| 1,932,385 | A | 10/1933 | Barthell | |
| 1,961,826 | A | 6/1934 | Welk | |
| 2,000,021 | A | 5/1935 | Hoffman et al. | |
| 2,144,911 | A * | 1/1939 | Cohn | 99/353 |
| 3,710,964 | A * | 1/1973 | Douglass, Jr. | 414/327 |
| 3,747,811 | A | 7/1973 | Lewis et al. | |
| 4,188,907 | A * | 2/1980 | Lipani | 399/261 |
| 4,475,671 | A * | 10/1984 | McCorkel | 222/196 |
| 5,008,580 | A * | 4/1991 | Masuda et al. | 310/321 |
| 6,062,720 | A * | 5/2000 | Ionadi | 366/117 |
| 6,214,294 | B1 * | 4/2001 | Shibutani et al. | 422/544 |
| 6,690,101 | B2 * | 2/2004 | Magnussen et al. | 310/328 |
| 6,809,461 | B2 * | 10/2004 | Kurita et al. | 310/328 |
| 7,665,633 | B2 * | 2/2010 | MacMichael et al. | 222/161 |
| 2005/0040185 | A1 | 2/2005 | MacMichael et al. | |

FOREIGN PATENT DOCUMENTS

| | | |
|---|---|---|
| DE | 1124330 | 2/1962 |
| DE | 1288839 | 2/1969 |
| DE | 102004023372 A1 | 12/2005 |
| FR | 2706430 A1 | 12/1994 |

* cited by examiner

*Primary Examiner* — Yogendra Gupta
*Assistant Examiner* — Emmanuel S Luk
(74) *Attorney, Agent, or Firm* — Ronald E. Greigg

(57) ABSTRACT

The present invention relates to an apparatus for homogenizing powder, which includes a drive device and a homogenization unit. The drive device moves the homogenization unit back and forth in at least one horizontal direction. The homogenization unit has a multitude of essentially vertically arranged, rod-shaped elements which are immersed at least partly into a powder to be homogenized.

20 Claims, 7 Drawing Sheets

(A)

APPARATUS FOR HOMOGENIZING POWDER

PRIOR ART

Cross-Reference to Related Application

This application is a 35 USC 371 application of PCT/EP 2007/055800 filed on Jun. 13, 2007.

BACKGROUND OF THE INVENTION

1. Field of the Invention

The present invention relates to an apparatus for homogenizing powder, in which the powder is then dispensed into a container, such as a capsule or a package.

2. Description of the Prior Art

An apparatus for homogenizing powder is known from the prior art, such that an agitator mechanism, for instance, is provided, having a rotating agitator that plunges into the powder and is rotated. By means of the rotating agitator, the attempt is made to break up so-called powder bridges. However, especially with very fine-grained powder such as medications or the like, it is still possible for the powder to stick together and clump. Moreover, agitator mechanisms require a relatively large amount of space.

ADVANTAGES AND SUMMARY OF THE INVENTION

The apparatus for homogenizing powder according to the invention has the advantage over the prior art that while having a simple construction and being economical to manufacture, it enables reliable homogenization of a powder. In particular, unwanted powder concentrations can be broken up with a high degree of process safety. In particular, homogenization can be done in a way that makes for very gentle product handling, as is necessary particularly for medications or the like. Moreover, the power can be adapted flexibly to different powdered products. This is attained according to the invention in that the apparatus for homogenizing powder includes a drive device and a homogenization unit. The drive device moves the homogenization unit back and forth at least in a horizontal direction. The homogenization unit includes many rod-shaped elements, which plunge at least partway into a powder that is to be homogenized. Thus by means of the driven homogenization unit, the rod-shaped elements are moved back and forth in a horizontal direction, so that the rod-shaped elements are moved through the powder in the lateral direction. The rod-shaped elements are disposed essentially in the vertical direction.

The rod-shaped elements preferably have a circular outer cross section. Alternatively, it would also be possible for the cross section of the rod-shaped elements to be oval or polygonal, such as hexagonal or octagonal.

Also preferably, the drive device includes an electromagnet and a vibration plate, with a pole element of a ferromagnetic material. The vibration plate is movably supported, and the pole element is disposed relative to the electromagnet such that between them, a vertical gap is formed, in order upon an actuation of the electromagnet to attract the pole element by means of magnetic force and to excite the vibration plate to vibrate. The homogenization unit is connected to the vibration plate and is moved back and forth in the horizontal direction by the excited vibration plate.

The vibration plate is preferably vibratably supported by means of at least one leaf spring. A plurality of leaf springs are advantageously provided here, in particular four leaf springs, one on each corner of the vibration plate.

In an alternative embodiment of the invention, the drive device includes a piezoelectric actuator or pneumatic actuator for moving the homogenization unit.

Preferably, the rod-shaped elements are embodied as small tubes and communicate with a pressure region that contains compressed air. It is thus possible to feed compressed air directly into the powder through the small tubes. This mixing in of compressed air has the advantage in particular that the flowability of the powder is improved significantly. The compressed air should preferably be dry. Moreover, the pressure of the compressed air should not be too high, to prevent blowing the powder away.

Also preferably, the homogenization unit includes a pressure chamber, in which a throttle restriction is disposed. The throttle restriction furnishes a uniform distribution of the compressed air among the small tubes disposed adjacent to one another.

In a further preferred feature of the invention, the throttle restriction is a block of a microporous, air-permeable material.

To enable fast and simple replacement of the homogenization unit by another homogenization unit, an adapter is preferably disposed between the drive device and the homogenization unit. The homogenization unit is secured to and released from the adapter. A fast replacement of the apparatus for homogenizing powder, for example for a different powdered product, can thus be performed. The adapter furthermore preferably has a compressed air connection.

In a further preferred embodiment of the invention, the rod-shaped elements embodied as small tubes have many openings on their free end, that is, on the end that has plunged into the powder. The openings may be provided in the form of pointlike openings and/or as slits. The slits can be embodied as straight slits and/or as curved slits. By the provision of the openings on the end of the small tubes that is plunged into the powder, improved and more-uniform introduction of air into the powder is achieved.

If the openings are embodied as slits, the slits preferably have a length that is equivalent to approximately ⅓ the circumference of the small tubes. The slits are especially preferably offset from one another along the circumference, at different heights and oriented in different directions.

Especially good homogenization of the powder can be achieved if a spacing of adjacent rod-shaped elements is uniform.

Also preferably, the rod-shaped elements have different lengths. In particular, the lengths of rod-shaped elements which are disposed on the edge of the vibration plate are shorter than rod-shaped elements farther toward the middle. As a result, an adaptation of the homogenization unit, for instance to a tapering container, such as a funnel-shaped container, in which the powder is stored can be achieved.

The present invention is used especially preferably in conjunction with a metering device for metering powder into vessels, such as capsules or the like. The powder may for instance be a medication, or a food, such as flour, coffee, cocoa, and so forth. Hence the invention is used especially preferably in bottling machines.

BRIEF DESCRIPTION OF THE DRAWINGS

Preferred exemplary embodiments of the invention will be described in detail below in conjunction with the drawings. In the drawings.

DESCRIPTION OF THE PREFERRED EMBODIMENTS

Figure 1:
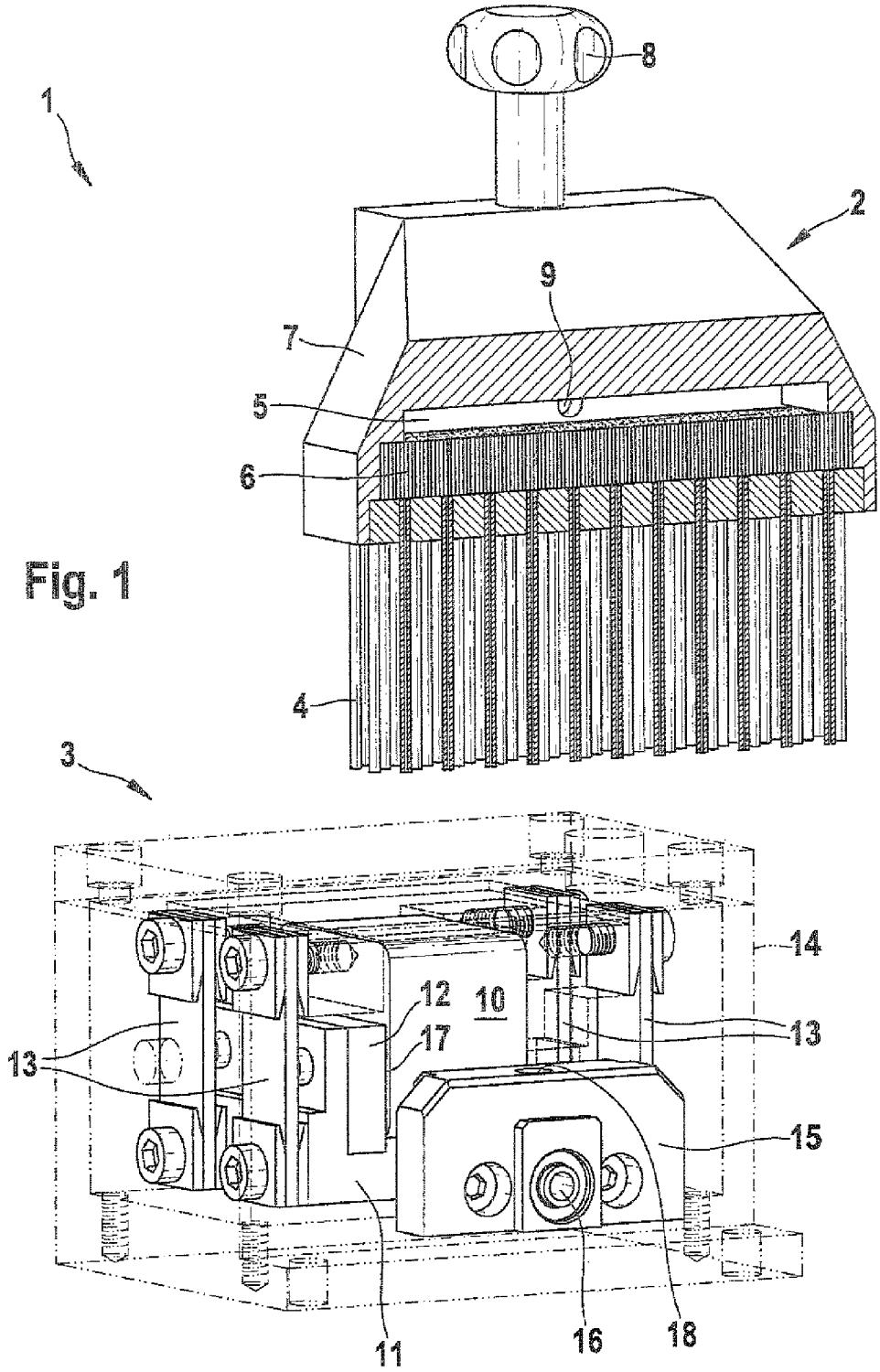
FIG. 1 is a schematic, perspective view of an apparatus for homogenizing powder in a first exemplary embodiment of the invention.

Below, an apparatus 1 for homogenizing powder will be described in detail in terms of a first exemplary embodiment of the invention, in conjunction with FIGS. 1 through 4. As shown in FIG. 1, the apparatus 1 for homogenizing powder includes two parts, namely a homogenization unit 2 and a drive device 3. The homogenization unit 2 includes many rod-shaped elements 4, which are disposed in the vertical direction. As FIG. 1 shows, two rows side by side of rod-shaped elements 4 are provided. Adjacent rod-shaped elements in each row have the same spacing from one another. The two rows are offset from one another. The rod-shaped elements 4 are shown in further detail in FIGS. 4*a* through 4*c*. As seen particularly in FIG. 4*c*, which is a perspective view of one rod-shaped element 4, the rod-shaped elements 4 are embodied as small tubes, with a wall 4*a* and a passage oriented in the longitudinal direction. Also, many slits 4*c* are disposed on the free end of the rod-shaped elements 4. Many slits 4*c* are also disposed on the free end of the rod-shaped elements 4. The slits 4*c* connect the passage 4*b* to the outside of the rod-shaped elements. FIG. 4*a* shows a schematic overview of a rod-shaped element 4; FIG. 4*b* shows a detail of the rod-shaped element.

The homogenization unit 2 further includes a housing 7, in which a pressure chamber 5 is disposed. In the pressure chamber 5, there is a throttle restriction 6, which is made from a microporous, air-permeable material. The throttle restriction 6 is disposed directly upstream, in the flow direction, of the rod-shaped elements 4 (see FIG. 1). As a result, it can be prevented that compressed air fed into the rod-shaped elements 4 has an excessively high pressure. The pressure chamber 5 of the homogenization unit 2 furthermore has a communicating opening 9, through which compressed air is fed.

Figure 2:
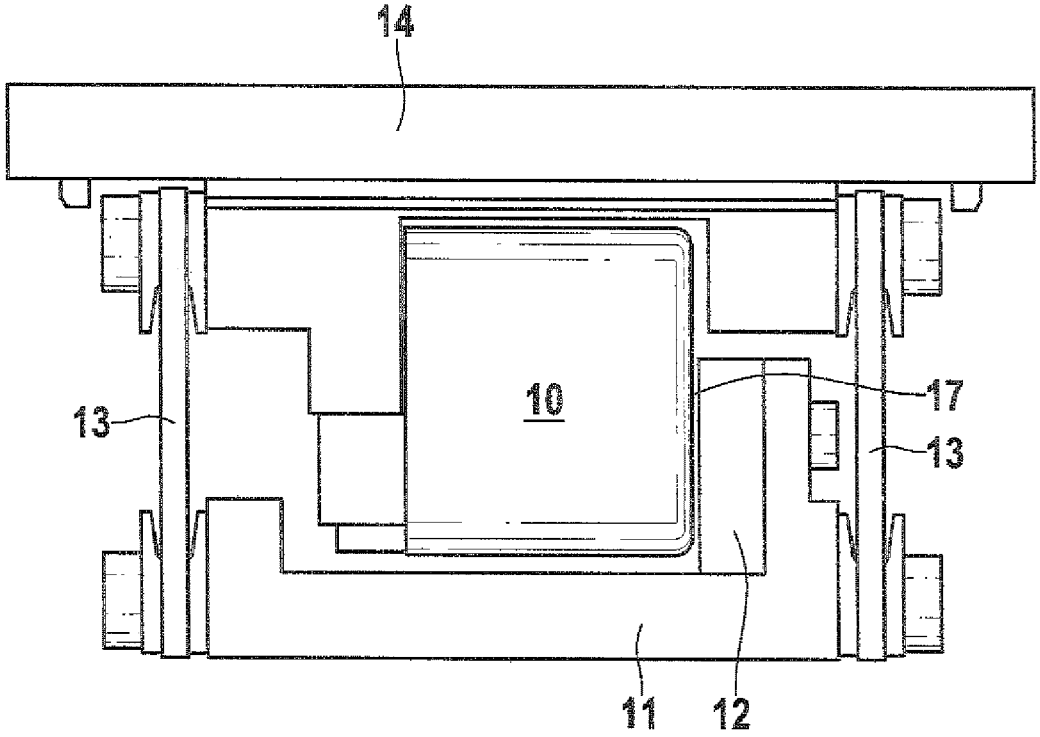
FIG. 2 is a view of the drive device, shown in FIG. 1, of the apparatus for homogenizing powder.

The drive device 3, which is shown in the lower part of FIG. 1, includes a centrally disposed electromagnet 10 and a vibration plate 11 with a pole element 12. The pole element 12 is secured to the vibration plate 11 and is oriented in the direction of the electromagnet 10. As FIG. 2 shows, which is a view from behind of the drive device 3 shown in FIG. 1, a vertical gap 17 is formed between the pole element 12 and the electromagnet 10. The vibration plate 11 is suspended vibratably from a housing 14 of the drive device 3 by means of four leaf springs 13. As can be seen from FIG. 1, two leaf springs 13 are disposed on each lateral end of the vibration plate 11.

An adapter 15 with a compressed air connection 16 is also disposed on the drive device 3. The adapter 15 is connected to the vibration plate 11, and in its upper region it has an opening 18 that is provided with a thread. By means of this opening, the homogenization unit 2 can be secured to the adapter 15 by means of a screw element 8. The screw element 8 has a large engagement region, so that securing and releasing the homogenization unit 2 to and from the drive device 3 can be done by hand. With the aid of the adapter 15, a drive device 3 can therefore be used for many different homogenization units, which can be replaced simply and quickly.

Figure 3:
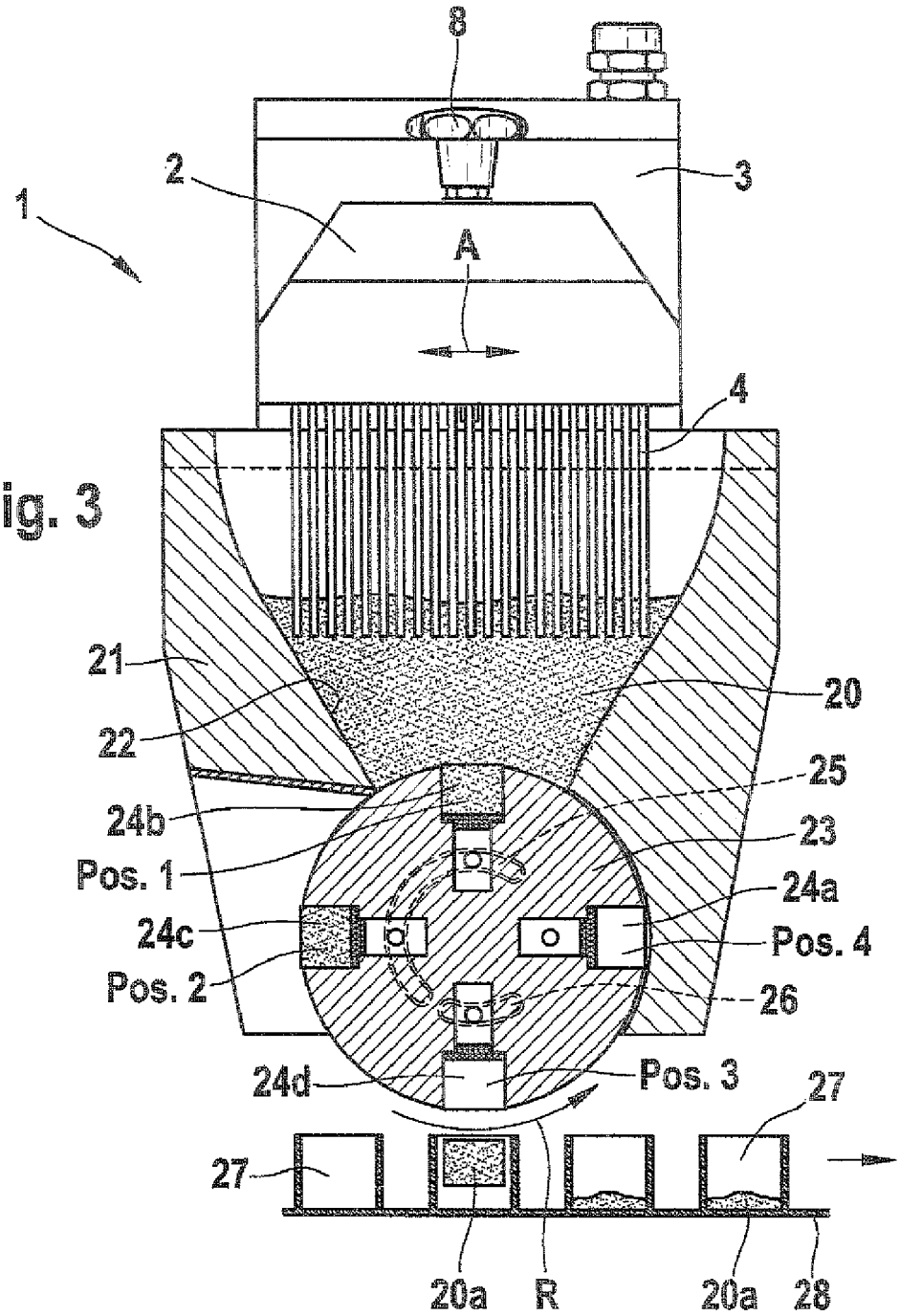
FIG. 3 is a sectional view of the apparatus for homogenizing powder of FIG. 1, which is used in conjunction with a vacuum filling wheel.
Figure 4A:
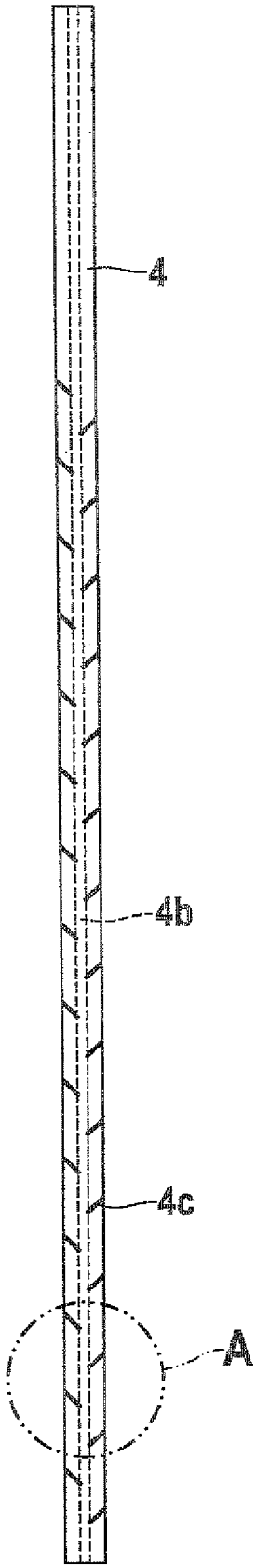
FIGS. 4*a*-4*c* show various views of a rod-shaped element of the homogenization unit.
Figure 4B:
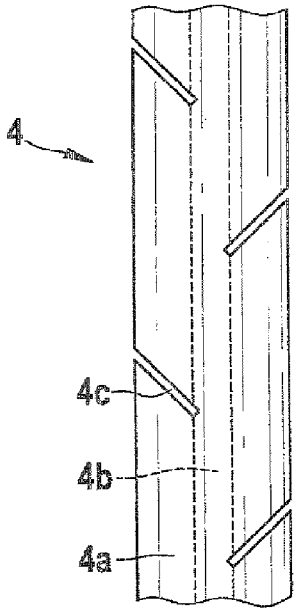
Figure 4C:
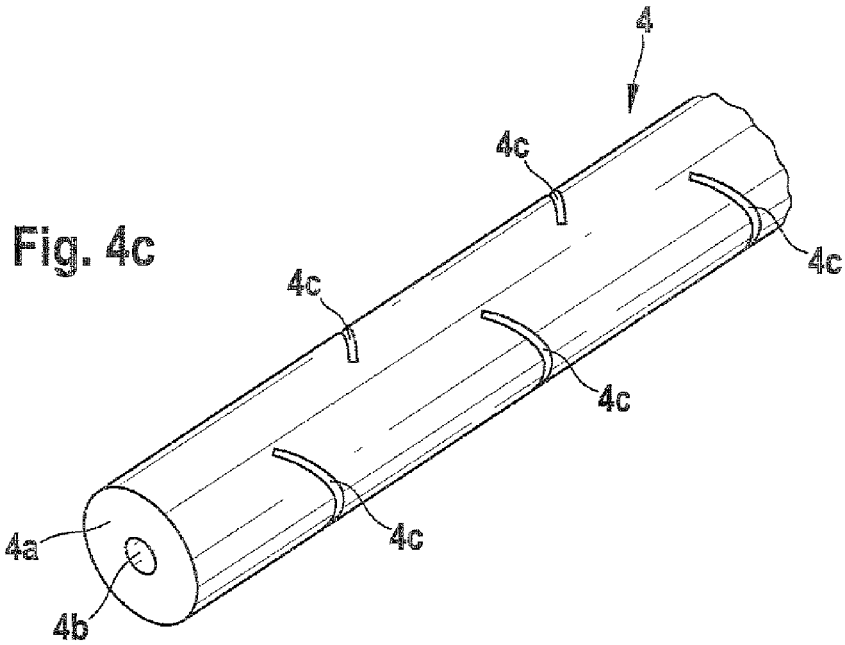

FIG. 3 shows a use of the apparatus 1 of the invention in a vacuum filling device 21. The vacuum filling device 21 includes a tapering supply chamber 22, in which powder 20 that is to be dispensed is disposed. The vacuum filling device 21 includes a filling wheel 23 with four metering chambers 24*a*, 24*b*, 24*c* and 24*d*, which are spaced apart uniformly from one another on the circumference of the filling wheel 23. Filling the metering chambers is effected by means of a curved underpressure region 25, by aspiration of the powder, and evacuation is effected by means of an overpressure region 26, by forcing out with the aid of gravity. Dispensing is done into containers 27, which are supplied on a conveyor belt 28. The filling wheel 23 rotates in the direction of the arrow R and is driven by a drive mechanism, not shown. Filling an individual metering chamber of the filling wheel 23 is effected such that in the position marked Pos. 1 of the metering chamber 24*b*, an underpressure is generated, since the metering chamber is in communication with the underpressure region 25. In the process, powder is aspirated into the metering chamber 24*b*. Filters are disposed on the bottom of each of the metering chambers 24*a*, 24*b*, 24*c* and 24*d*, in order to prevent the aspirated powder from being aspirated into the underpressure region 25. The filling wheel 23 rotates onward to position 2 (Pos. 2), in which the metering chamber is still in communication with the underpressure region 25. In position 3 (Pos. 3), the metering chamber then communicates with the overpressure region 26, so that the powder 20*a* metered in the metering chamber is forced out of the metering chamber. In the process, the evacuation of the metering chamber is further reinforced by gravity. The metered powder 20 then drops into a container 27, as shown in FIG. 3.

To enable metering that is as fast and precise as possible, the powder 20 must be present as homogeneously as possible in the supply chamber 22. This is attained by means of the apparatus 1 of the invention. The rod-shaped elements 4 of the homogenization unit 2 are plunged partway into the powder 20 located in the supply chamber 22. The drive device 3 moves the homogenization unit 2 back and forth horizontally in the direction of the double arrow A. By means of the rod-shaped elements 4, which all have a circular outer cross section and are embodied as small tubes, product concentrations, which can occur particularly at the surface of the powder in the supply chamber 22, are broken up. At the same time, compressed air is also fed through the rod-shaped elements 4, embodied as small tubes, into the powder 20 through the exposed end of the passage 4*b* and through the slits 4*c*. As a result of this mixing in of compressed air, the flowability of the powder 20 is improved significantly. As a result, the homogenization of the powder 20 is done in a way that is especially gentle to the product.

By means of the homogenization apparatus 1 according to the invention, the most uniform possible introduction of vibrational energy into the powder 20 can thus be attained. This further reinforces the breaking up of unwanted powder concentrations, especially at the surface.

Below, in conjunction with FIGS. 5 and 6, an apparatus 1 for homogenizing powder will be described in detail in terms of a second exemplary embodiment of the invention. Elements that are the same or are functionally the same are identified by the same reference numerals as in the first exemplary embodiment.

Figure 5:
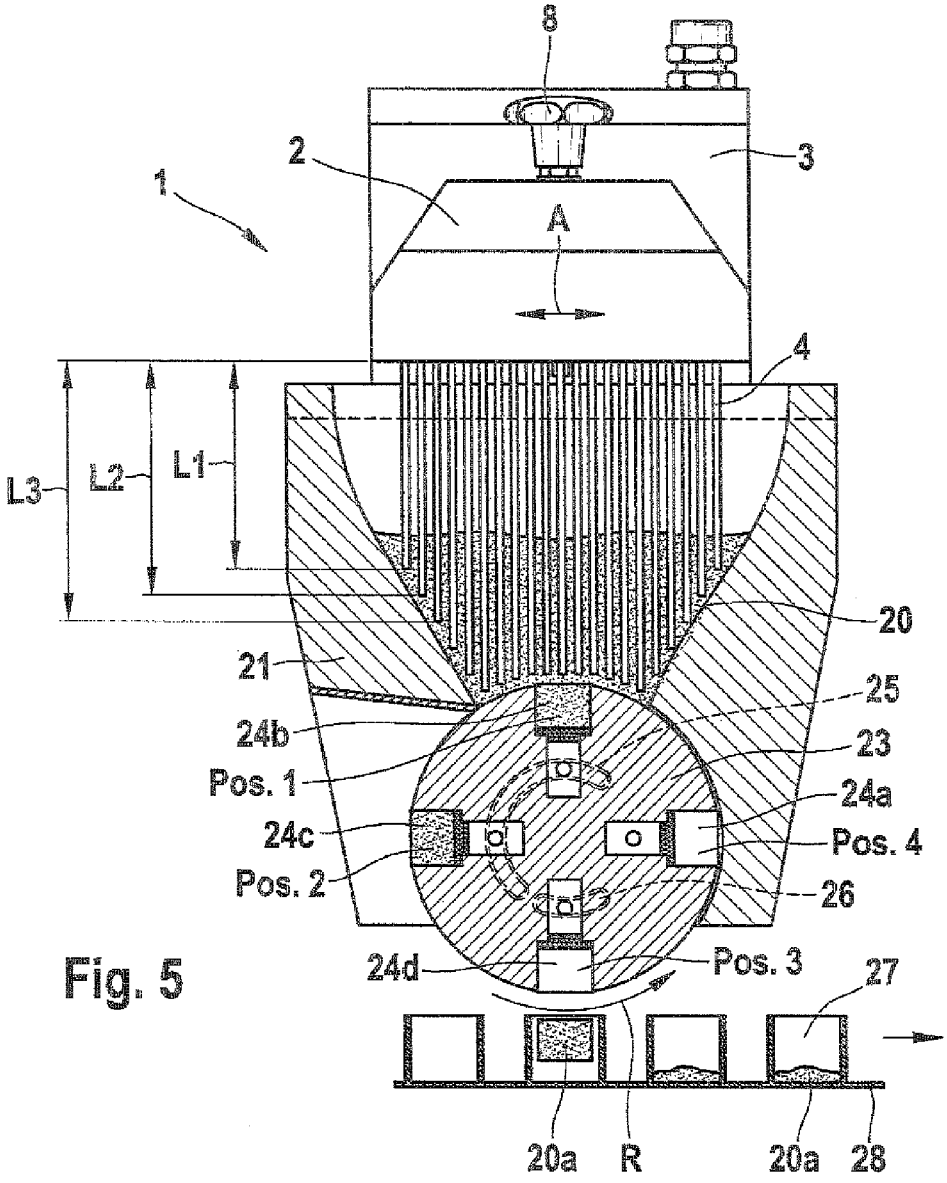
FIG. 5 is a schematic sectional view of a homogenizing apparatus in a second exemplary embodiment of the invention, in conjunction with a vacuum filling wheel.

As shown in FIG. 5, the apparatus 1 for homogenizing powder is essentially equivalent to that in the first exemplary embodiment. Unlike the first exemplary embodiment, however, the apparatus 1 for homogenizing powder in the second exemplary embodiment has rod-shaped elements 4 which have different lengths L1, L2, L3. As seen particularly in FIG. 5, the lengths of the individual rod-shaped elements 4 are each selected such that they adapt to the tapering shape of the supply chamber 22 and to the outer circumference of the filling wheel 23. As a result, the rod-shaped elements 4 can be made to plunge more deeply into the powder 20 than in the exemplary embodiment. Once again, the rod-shaped elements 4 are embodied as small tubes and are provided with openings in the form of slits; the slits are formed at least over the region of the rod-shaped elements 4 that has plunged into the powder 20. The homogenization unit 2 is again driven back and forth in the horizontal direction in the direction of the double arrow A by the drive device 3. The path of motion of the homogenization unit in one direction and the other is relatively short, to avoid damage to the rod-shaped elements 4 from contact with the supply chamber 22.

Figure 6:
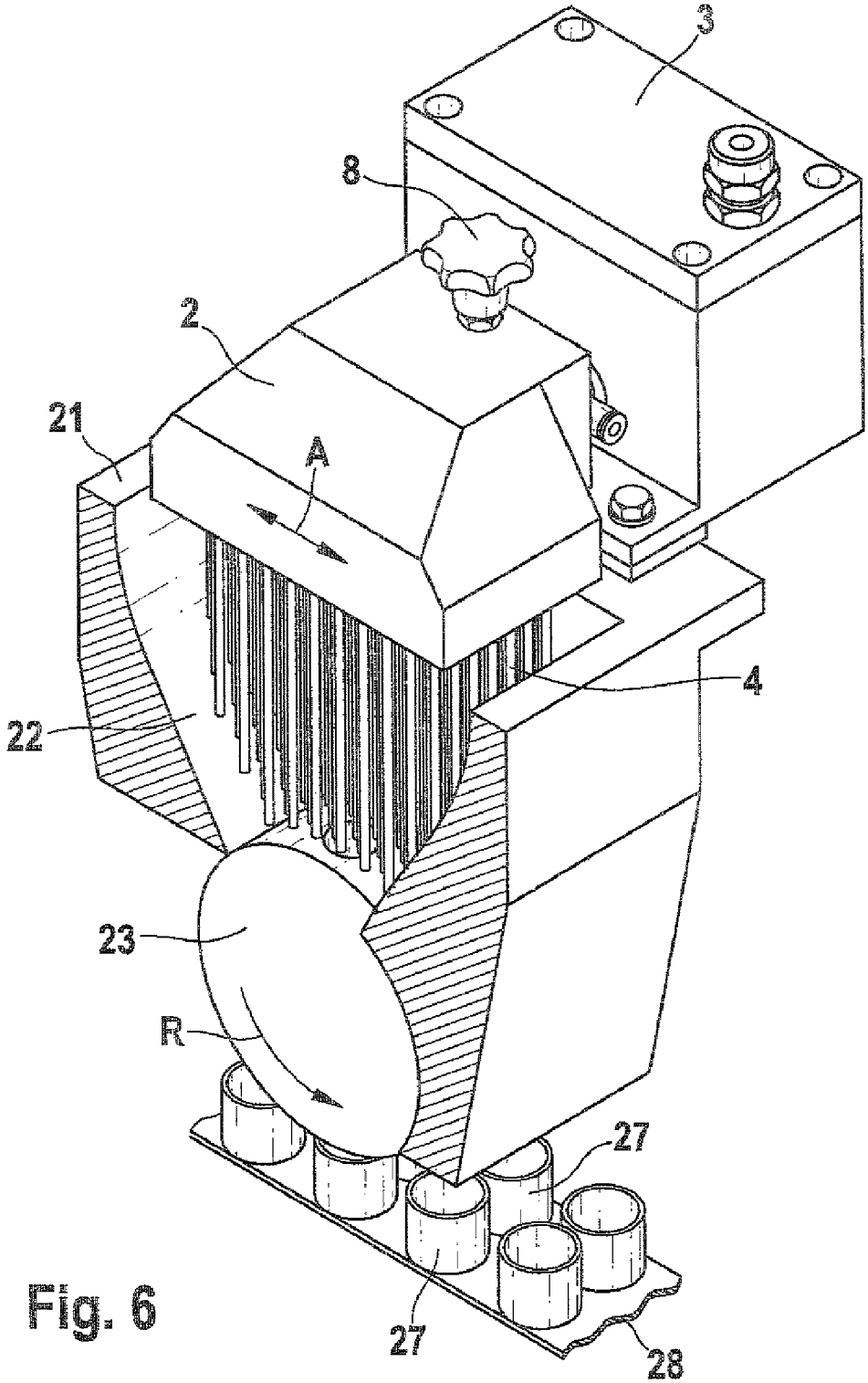
FIG. 6 is a perspective view of the apparatus shown in FIG. 5.

As can be seen from FIG. 6, the filling wheel 23 is moreover embodied as a double filling wheel, so that simultaneously and parallel, two containers 27 can be filled with metered powder 20*a*. This doubles the capacity of the filling machine. Otherwise, this exemplary embodiment is equivalent to the first exemplary embodiment, so that the description thereof can be referred to.

It should be noted that the drive device 3, for all the exemplary embodiments described, can also be embodied such that the homogenization unit 2 is moved back and forth in two different directions. The devices then are especially preferably perpendicular to one another. In this respect it is possible for the motion in two different directions to be executed successively, or for the two directions of motion to overlap, resulting in a circular or oval motion.

The foregoing relates to the preferred exemplary embodiments of the invention, it being understood that other variants and embodiments thereof are possible within the spirit and scope of the invention, the latter being defined by the appended claims.

The invention claimed is:

1. An apparatus for homogenizing powder, comprising:

a drive device; and a homogenization unit, wherein the drive device moves the homogenization unit back and forth in at least a horizontal direction, and wherein the homogenization unit includes many substantially vertically disposed rod-shaped elements which plunge at least partway into a powder to be homogenized, wherein, the rod-shaped elements are embodied with a passage through which compressed air is fed into the powder.

2. The apparatus as defined by claim 1, wherein the rod-shaped elements have a circular outer cross section.

3. The apparatus as defined by claim 1, wherein the drive device includes an electromagnet and a vibration plate with a pole element of ferromagnetic material, the vibration plate being vibratably supported, an axial gap formed between the pole element and the electromagnet in order upon an actuation of the electromagnet to excite the vibration plate to vibrate, the homogenization unit being connected to the vibration plate.

4. The apparatus as defined by claim 2, wherein the drive device includes an electromagnet and a vibration plate with a pole element of ferromagnetic material, the vibration plate being vibratably supported, an axial gap formed between the pole element and the electromagnet in order upon an actuation of the electromagnet to excite the vibration plate to vibrate, the homogenization unit being connected to the vibration plate.

5. The apparatus as defined by claim 2, wherein the drive device includes a piezoelectric actuator or a pneumatic actuator for moving the vibration plate.

6. The apparatus as defined by claim 3, wherein the drive device includes a piezoelectric actuator or a pneumatic actuator for moving the vibration plate.

7. The apparatus as defined by claim 3, wherein the vibration plate is vibratably supported by means of at least one leaf spring.

8. The apparatus as defined by claim 4, wherein the vibration plate is vibratably supported by means of at least one leaf spring.

9. The apparatus as defined by claim 1, wherein the rod-shaped elements are embodied as small tubes, and the rod-shaped elements communicate with a pressure region, in order to feed the compressed air into the powder.

10. The apparatus as defined by claim 9, wherein the pressure region includes a pressure chamber in the homogenization unit, and a throttle restriction is disposed in the pressure chamber and assures a uniform distribution of the compressed air into the rod-shaped elements and throttles the pressure of the compressed air to a predetermined value.

11. The apparatus as defined by claim 10, wherein the throttle restriction is embodied by a block of a microporous, air-permeable material.

12. The apparatus as defined by claim 1, wherein an adapter is disposed between the drive device and the homogenization unit, in order to enable simple replacement of the homogenization unit.

13. The apparatus as defined by claim 9, wherein the rod-shaped elements embodied as small tubes have many openings, in particular many slits, on their free end, which slits connect the passage to outside of the rod-shaped elements.

14. The apparatus as defined by claim 10, wherein the rod-shaped elements embodied as small tubes have many openings, in particular many slits, on their free end, which slits connect the passage to outside of the rod-shaped elements.

15. The apparatus as defined by claim 11, wherein the rod-shaped elements embodied as small tubes have many openings, in particular many slits, on their free end, which slits connect the passage to outside of the rod-shaped elements.

16. The apparatus as defined by claim 13, wherein the slits have a length which is equivalent to approximately one third of a circumference of the rod-shaped elements.

17. The apparatus as defined by claim 14, wherein the slits have a length which is equivalent to approximately one third of a circumference of the rod-shaped elements.

18. The apparatus as defined by claim 1, wherein a spacing of rod-shaped elements adjacent to one another is uniform.

19. The apparatus as defined by claim 1, wherein the rod-shaped elements have different lengths.

20. A metering device for metering a powder into a container, including a homogenizing apparatus having a drive device and a homogenization unit, wherein the drive device moves the homogenization unit back and forth in at least a horizontal direction, and wherein the homogenization unit includes many substantially vertically disposed rod-shaped elements which plunge at least partway into a powder to be homogenized, wherein, the rod shaped elements are embodied with a passage through which compressed air is fed into the powder.

* * * * *